United States Patent [19]

Shaw

[11] 4,122,656

[45] Oct. 31, 1978

[54] COATED PINNED ROLLER

[75] Inventor: Jack Shaw, Burnley, England

[73] Assignee: Platt Saco Lowell Limited, Helmshore, England

[21] Appl. No.: 839,872

[22] Filed: Oct. 6, 1977

Related U.S. Application Data

[63] Continuation-in-part of Ser. No. 590,859, Jun. 27, 1975, Pat. No. 4,058,965.

[30] Foreign Application Priority Data

Oct. 19, 1976 [GB] United Kingdom ..... 43268/76

[51] Int. Cl.[2] ..... D01H 1/12

[52] U.S. Cl. ..... 57/58.91; 19/112

[58] Field of Search ..... 57/34 R, 58.89, 58.91, 57/58.95; 19/97, 112, 114

[56] References Cited

U.S. PATENT DOCUMENTS

| | | | |
|---|---|---|---|
| 3,387,338 | 6/1968 | Kanai et al. | 19/114 |
| 3,626,681 | 12/1971 | Naruse | 57/58.91 |
| 3,685,272 | 8/1972 | Greenwood et al. | 57/58.91 X |
| 3,737,951 | 6/1973 | MacKie | 19/97 |
| 3,775,956 | 12/1973 | Rajnoha et al. | 57/58.91 |
| 3,841,075 | 10/1974 | Kutscher et al. | 57/58.91 |
| 3,853,494 | 12/1974 | Graf | 19/114 X |
| 3,916,045 | 10/1975 | Ibbotson et al. | 19/114 X |
| 4,058,965 | 11/1977 | Shaw et al. | 57/58.91 |

FOREIGN PATENT DOCUMENTS

| | | | |
|---|---|---|---|
| 1,387,627 | 3/1975 | United Kingdom | 57/58.91 |

*Primary Examiner*—Donald Watkins
*Attorney, Agent, or Firm*—Donald H. Feldman

[57] ABSTRACT

An opening roller for opening fibres fed to an open-end spinning machine has a cylindrical shell outwardly from which protrude a plurality of fibre-engaging teeth, each of which has a coating of wear-resistant ceramics or metallic material applied thereto. The teeth are formed as pointed ends of a plurality of pins passing through the cylindrical shell and the coating applied so as to cover the whole surface of each of the pins.

The opening roller is provided with a flange extending from each end of the cylindrical shell and the wear-resistant coating may be applied to each of the protruding tooth portions, the outer surface of the cylindrical shell and the inner surface of the flanges.

3 Claims, 3 Drawing Figures

COATED PINNED ROLLER

CROSS REFERENCE TO RELATED APPLICATION

This application is a continuation-in-part of application Ser. No. 590,859, filed on June 27, 1975 and now U.S. Pat. No. 4,058,965.

FIELD OF THE INVENTION

This invention relates to opening rollers for use in apparatus for open-end spinning textile yarns.

In one known type of open-end spinning machine a sliver of fibrous material is fed to an opening roller which performs an opening and combing operation on the sliver. The opened and combed fibres from the sliver are subsequently supplied to a spinning rotor on the internal collecting surface of which they are collected as a fibrous ring. This fibrous ring is twisted into a tail end of previously spun yarn to form a continuous yarn.

In order to perform the opening action on the sliver, the opening roller is provided with fibre-engaging teeth formed either on a continuous base wound in a helical path around the peripheral surface of the opening roller, or as pointed ends on a plurality of pins protruding from the outer surface of the roller. In operation, it has been found that the abrasive action of the fibres causes rapid wear of the teeth. This quickly reduces the effectiveness of the opening roller in that the fibre opening action is impaired and results in the production of an inferior yarn.

DESCRIPTION OF THE PRIOR ART

In British Pat. No. 1,375,772 there is disclosed a strip of metallic wire comprising a base portion and a plurality of saw-type fibre-engaging teeth protruding therefrom, which may be wound around the peripheral surface of an opening roller for an open-end spinning machine. In order to prevent wear of the fibre engaging teeth, a hard layer, selected from a group consisting of vanadium carbide, niobium carbide and tantalum carbide is applied by a diffusion treatment.

However, since the cross-section of the wire varies quite substantially from a small area at the tip of the teeth to a larger area forming the base of the wire, difficulties are experienced in obtaining a constant value of the desired hardness over the surface of the teeth. This is due to the varying temperature of the material of the wire over its' cross-section during treatment. Thus this proposal has not satisfactorily overcome the problem of tooth wear. Furthermore, metallic wire of this type has not been satisfactory in performing the opening action on the whole range of fibres processed on open-end spinning machines.

It is also known to make the pins of an opening roller from steel and to then subject the pins to a heat-treatment process so as to produce a pin with a hard wear-resistant surface. However, pins produced in this manner have not withstood effectively the abrasive action of the fibres and wearing of the pins has still occurred.

SUMMARY OF THE INVENTION

It is an object of the invention to provide an opening roller for use in apparatus for open-end spinning yarns in which the fibre-engaging teeth thereof are resistant to wear.

The invention provides an opening roller for opening textile fibres in an open-end spinning machine, comprising a cylindrical shell portion, a plurality of pins passing through said shell portion each of the pins having a body portion and a fibre-engaging tooth portion protruding outwardly from the shell portion, wherein a coating of wear-resistant material is applied to each of the fibre-engaging teeth. The wear-resistant coating is preferably a ceramics or a metallic material such as carbochrome.

DESCRIPTION OF THE PREFERRED EMBODIMENTS

Figure 1:
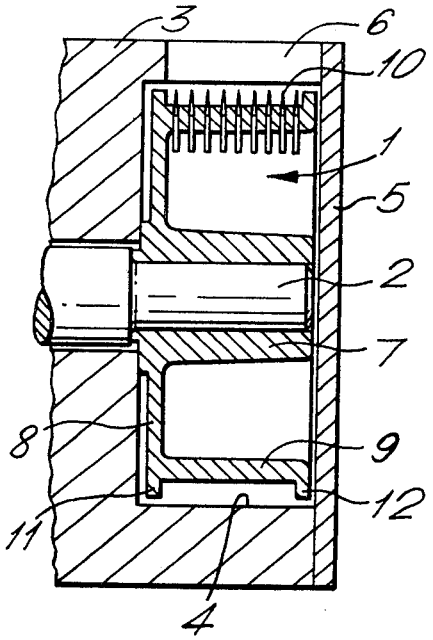
FIG. 1 is a cross-sectional end elevation of an opening roller according to the invention, mounted for rotation in a cavity formed in a housing of an open-end spinning machine.

Referring firstly to FIG. 1, an opening roller 1 is mounted on one end of a shaft 2 which is rotatably mounted in a housing 3. A cavity 4 is formed in the housing 3 to accommodate the opening roller 1 and is closed by a cover member 5. Communicating with the cavity 4 is a duct 6 through which in operation, a sliver is fed to the opening roller 1.

The opening roller 1 comprises a boss portion 7 an end wall 8 extending radially from one end of the boss portion 7 to form an end face of the roller and a cylindrical shell portion 9 which provides a location for a plurality of pins 10. Extending from the shell portion 9 at the ends thereof are peripheral flanges 11, 12, the inner surfaces of which form a channel with the outer surface of the shell portion 9.

Figure 2:
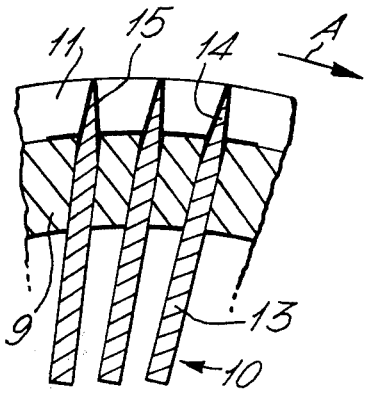
FIG. 2 is a cross-section through a fragment of the cylindrical shell of the opening roller shown in FIG. 1 according to a first aspect of the invention.
Figure 3:
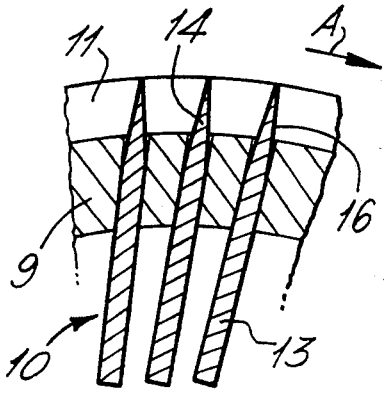
FIG. 3 is a cross-section through a fragment of the cylindrical shell of the opening roller shown in FIG. 1 according to a second aspect of the invention.

As best seen in FIGS. 2 and 3 each pin 10 is formed by a body portion 13 of constant circular cross-section and a tapering tooth portion 14 protruding from the outer shell portion 9 and terminating in a point. The junction of the body portion 13 and the tapering portion 14 is set below the outer surface of the shell portion 9. The body portion 13 terminates within the recess defined by the inner surfaces of the shell portion 9, the end wall 8, and boss portion 7. Each pin is forwardly inclined with respect to the direction of rotation of the opening roller indicated by the arrow A.

In operation, a sliver is fed to the opening roller 1 by a sliver feeding device (not shown) through the duct 6 formed in the housing 3. The opening roller is revolved at high speed by drive means (not shown) operating on the shaft 2 so that the sliver is subjected to an opening and combing action by the tooth portion 14 of the pins 10. The fibres from the sliver are conveyed by the opening roller 1 to the entrance of a fibre feed passage where they are removed from the opening roller 1 and transferred down the fibre feed passage to a spinning element such as, for example, a spinning rotor where the fibres are continuously spun into a yarn.

To counteract wearing of the pins, at least the tooth portion 14 protruding from the outer surface of the shell portion 9 is coated with a material having a high hardness value.

In the embodiment shown in FIG. 2, a coating 15 of ceramics material is sprayed so as to coat the whole of the protruding portion of tooth 14, the outer surface of the shell 9 and the inside surfaces of the flanges 11 and 12. Thus a hard smooth surface of uniform finish covers the fibre contacting surfaces of the roller. In addition to providing a wear-resistant surface, the smooth ceramics coating provides a surface free from fibre snagging points and thus deters the detrimental build-up of fibres.

In the embodiment shown in FIG. 3 a coating 16 of ceramics material is applied to the whole surface of the pin 10 before the pins are fitted in the roller shell 9.

The coating may be a hard metallic material such as carbo-chrome applied to the pin by known surface treatment or metal finishing techniques, such as, for example, carburising, diffusion coating or electrodeposition.

The hardness value of the wear-resistant coating according to the Vickers Hardness Test is within the range 650–1400 and preferably is of the order of 1075. The thickness of the wear-resistant coating is preferably of the order of 0.035 mms.

I claim:

1. In an opening roller used for separating textile fibers in an open end spinning machine, which roller comprises a cylindrical shell and a plurality of pins fixed to said shell and protruding outwardly from its cylindrical surface, said pins each having a body portion fixed to said shell and a fiber-engaging portion protruding outwardly therefrom, the improvement wherein said fiber-engaging portion has a wear-resistant surface formed with a coating of carbo-chrome.

2. In an opening roller used for separating textile fibers in an open end spinning machine, which roller comprises a cylindrical shell and a plurality of pins fixed to said shell and protruding outwardly from its cylindrical surface, said pins each having a body portion fixed to said shell and a fiber-engaging portion protruding outwardly therefrom, the improvement wherein said fiber-engaging portion has a wear resistant surface formed with a coating of a wear-resistant ceramic.

3. The improvement as in claim 2, wherein said roller further comprises an annular flange at each end of said cylindrical surface extending beyond said surface with an inner wall adjacent said surface to form a channel between said inner walls into which said pins protrude, said improvement further comprising said flange inner walls and said cylindrical surface therebetween having surfaces formed with said coating of said wear-resistant ceramic.

* * * * *